US007517232B2

(12) United States Patent
Yuan et al.

(10) Patent No.: US 7,517,232 B2
(45) Date of Patent: Apr. 14, 2009

(54) ELECTRICAL CONNECTOR WITH IMPROVED TERMINALS

(75) Inventors: Wei Yuan, ShenZhen (CN); Yu-San Hsiao, Tu-Cheng (TW); Jin-Feng Lei, ShenZhen (CN); Yi-Xin Chen, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/824,888

(22) Filed: Jul. 3, 2007

(65) Prior Publication Data

US 2008/0003862 A1 Jan. 3, 2008

(51) Int. Cl.
*H01R 12/00* (2006.01)

(52) U.S. Cl. ..... 439/79

(58) Field of Classification Search ..... 439/79, 439/80, 264

See application file for complete search history.

(56) References Cited

U.S. PATENT DOCUMENTS 4,722,691 A * 2/1988 Gladd et al. ..... 439/79
7,186,126 B2 * 3/2007 Umehara et al. ..... 439/247
2003/0096517 A1 * 5/2003 Ho ..... 439/79

FOREIGN PATENT DOCUMENTS

TW M254753 1/2005

* cited by examiner

*Primary Examiner*—Phuong K Dinh
(74) *Attorney, Agent, or Firm*—Wei Te Chung

(57) ABSTRACT

An electrical connector comprises an insulative housing and a plurality of terminals. The insulative housing defines a mating face, an end face parallel to the mating face, a mounting face perpendicular to the end face, a first receiving port and a second receiving port extending along a longitudinal direction perpendicular to a direction from the end face to the mating face with a plurality of receiving passageways therein. The plurality of terminals are assembled to the receiving passageways of the first receiving port and the second receiving port of the insulative housing respectively. Each terminal comprises a retaining portion securely retained with the insulative housing, a contacting portion extending forwardly from the retaining portion, a buffering portion extending backwardly from the retaining portion, a tail portion extending parallel to the mating face and a substantial upright portion interconnecting with the buffering portion and the tail portion.

11 Claims, 6 Drawing Sheets

ELECTRICAL CONNECTOR WITH IMPROVED TERMINALS

BACKGROUND OF THE INVENTION

1. Field of the Invention

The present invention relates to an electrical connector, and particularly to an electrical connector for mounting on a circuit board having different designs and configurations.

2. Description of the Prior Art

Please refer to U.S. 20030096517 A1 invented by Yi-Tse Ho, Ho discloses an electrical connector 1 for mounting on a circuit board 2, comprising an insulative housing 11, a plurality of terminals 12 disposed therein and a pair of locking elements 1194 locking the electrical connector 1 with the circuit board 2. Each terminal 12 comprises a horizontally extending connecting end 121, a contacting portion 1211 extending forwardly from the connecting end 121, a mating end 122 having a height difference with respect to the connecting end 121 and securing portion 123 connecting the connecting end 121 and the mating end 122 and being substantially upright. Particularly refer to FIGS. 3-4 of Ho, the locking elements 1194 pass through the electrical connector 1 and lock with the circuit board after the assembly is completed. Under that condition, a pre-pressure force exerting on the housing 11 are required. Accordingly, the mating ends 122 of the terminals 12 bear a upright force exerted by top surface of the circuit board 2. Therefore, it is inevitable to encounter a danger that the terminals 12 pivot at middle portion thereof within the housing 11. A reliable electrical connection will be affected. A similar electrical connector disclosed by Chiang (TW M254753) also suffers from the same problem.

Further refer to U.S. Pat. No. 7,186,126 B2 invented by Umehara et al., Umehara et al. discloses a floating electrical connector 1 comprising a plurality of contacts 10, an insulating movable housing 20, an insulating fixed housing 30 and a pair of pin bodies 40. Each of the contacts 10 comprises a retention section 11 press-fitted into the movable housing 20, a mating section 12 extending forward from the retention section 11, an inverted S-shaped link 13 extending rearward from the retention section 11, a retention section 14 providing at the rear end of the link 13 and press-fitted to the fixed housing 30 and a terminal section 15 extending downward and connecting to a circuit board. Such a structure of the electrical connector 1 is so complicated and high cost. The contacts 10 may be destroyed in case of a movement between the insulating movable housing 20 and the insulating fixed housing 30.

Hence, an improved electrical connector is desired to overcome the disadvantages of the prior art.

BRIEF SUMMARY OF THE INVENTION

Therefore, a main object of the present invention is to provide an electrical connector for establishing a reliable electrical connection with a circuit board.

To fulfill the above-mentioned object, an electrical connector according to the present invention comprises an insulative housing and a plurality of terminals. The insulative housing defines a mating face, an end face parallel to the mating face, a mounting face perpendicular to the end face, a first receiving port and a second receiving port extending along a longitudinal direction perpendicular to a direction from the end face to the mating face with a plurality of receiving passageways therein. The plurality of terminals are assembled to the receiving passageways of the first receiving port and the second receiving port of the insulative housing respectively. Each terminal comprises a retaining portion securely retained with the insulative housing, a contacting portion extending forwardly from the retaining portion, a buffering portion extending backwardly from the retaining portion, a tail portion extending parallel to the mating face and a substantial upright portion interconnecting with the buffering portion and the tail portion.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
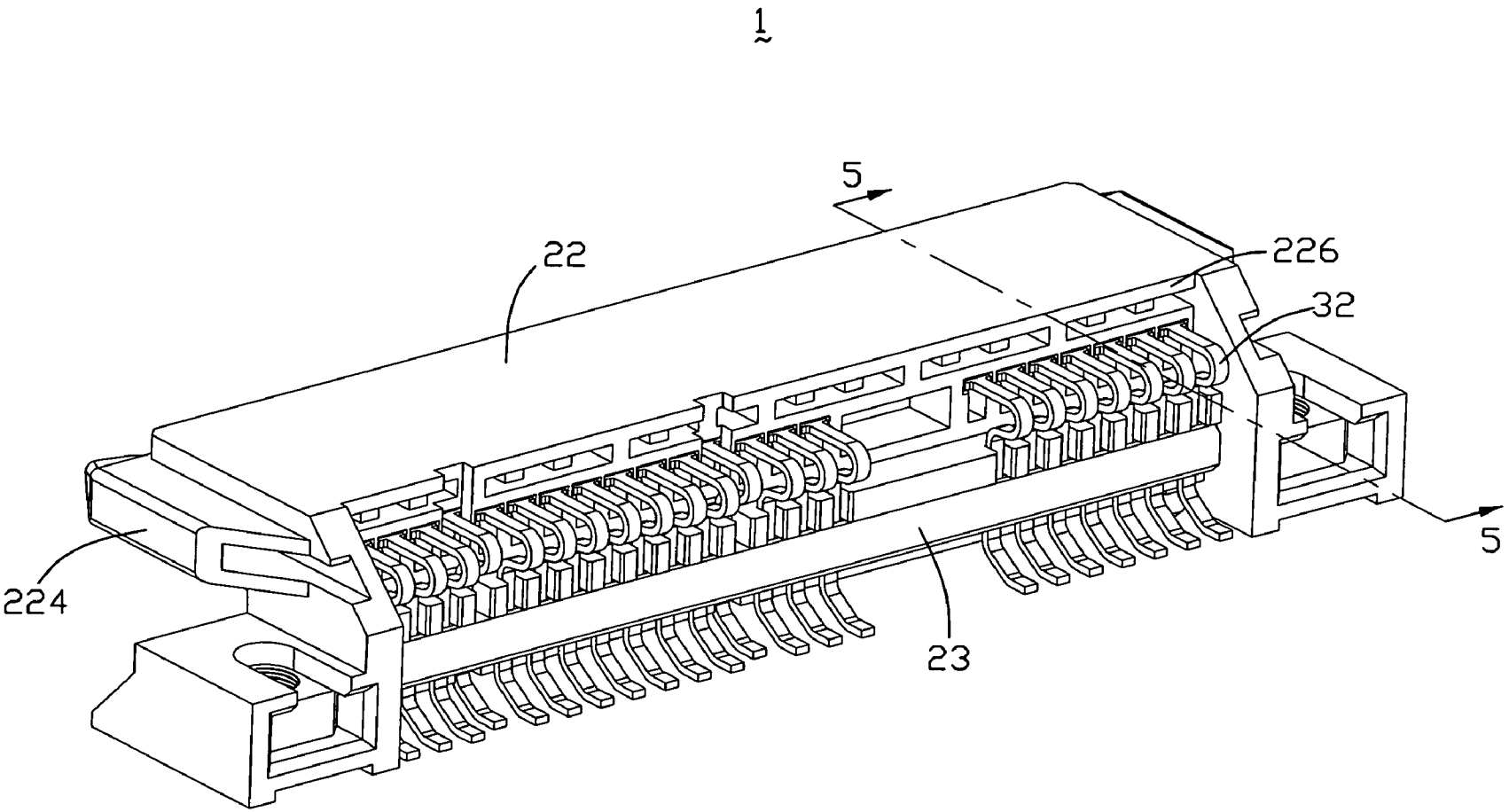
FIG. 1 is an assembled, perspective view of an electrical connector according to the present invention.
Figure 2:
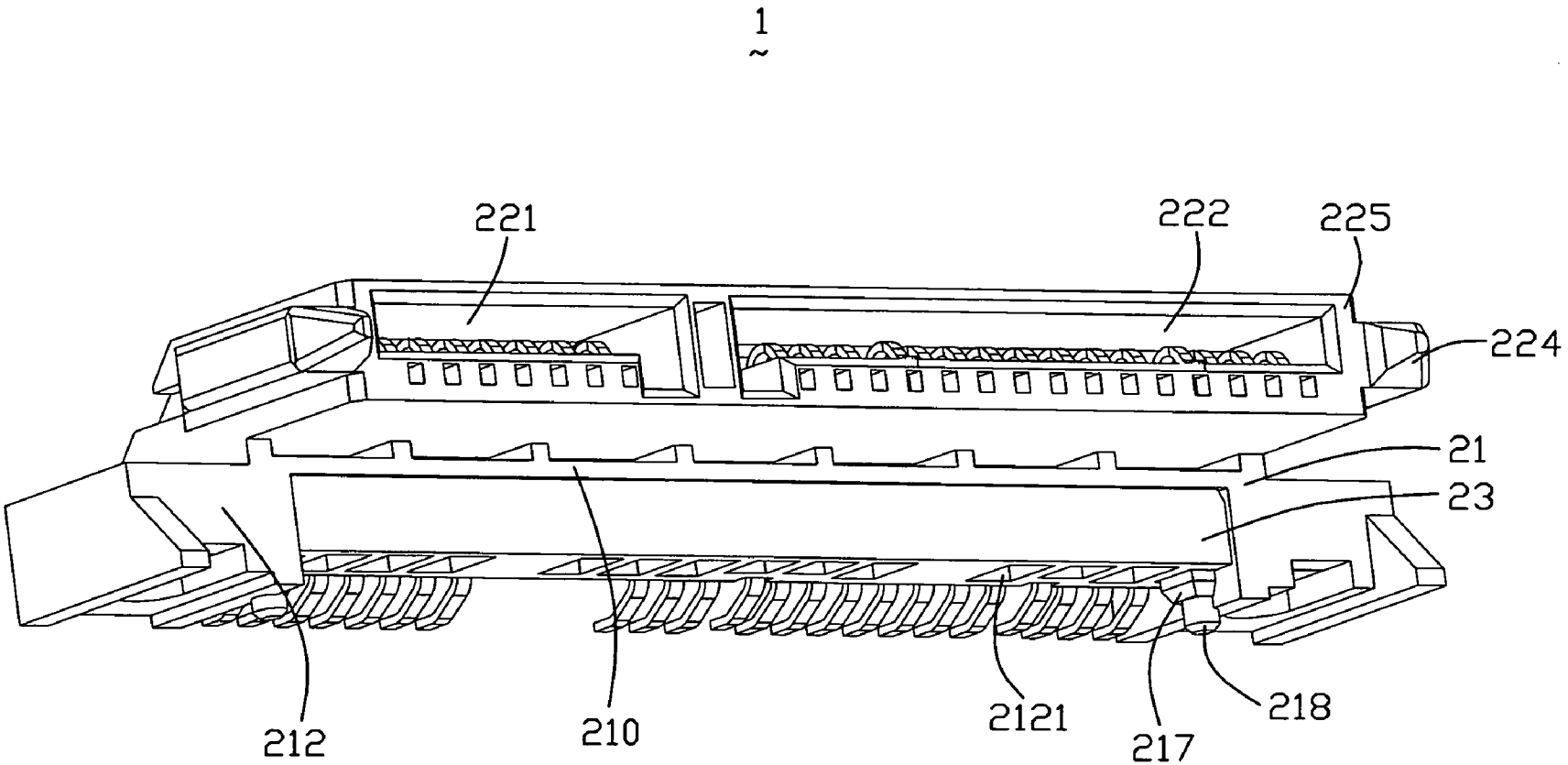
FIG. 2 is a view similar to FIG. 1, but viewed from another aspect.
Figure 3:
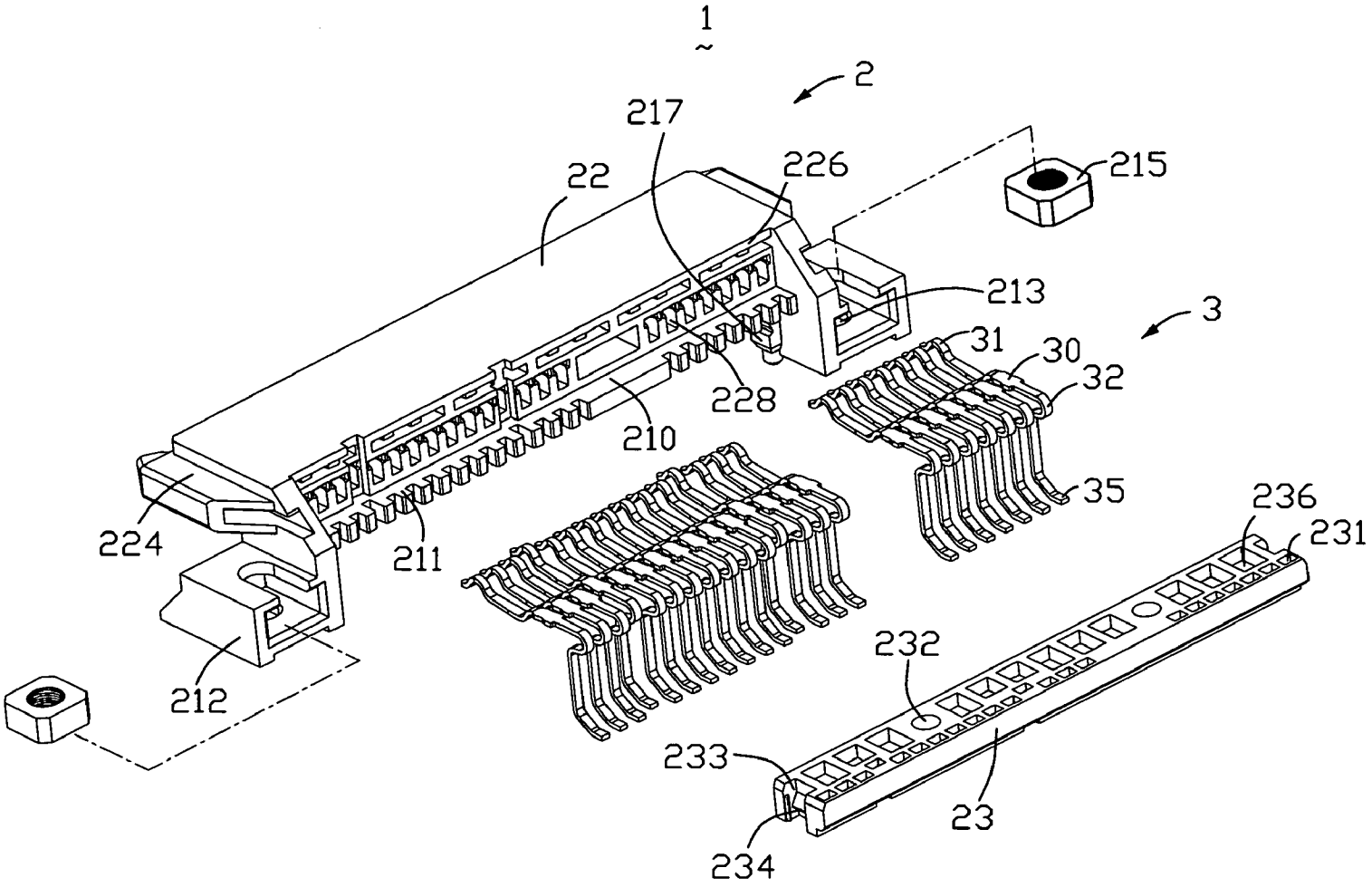
FIG. 3 is an exploded, perspective view of FIG. 1.

Referring to FIGS. 1-3, an electrical connector 1 according to the present invention is adapted for mounting on a circuit board (not shown) and connecting a complementary connector (not shown). The electrical connector 1 comprises an insulative housing 2 and a plurality of terminals 3 disposed therein.

The insulative housing 2 is substantially elongated and integrally formed, and comprises a base section 21 and a mating section 22 extending upwardly and forwardly from the base section 21.

The mating section 22 is substantially flat and elongated, and comprises a long direction and a short direction perpendicular to the long direction, a mating face 225 disposed at a front end of the mating section 22, an end face 226 located at a rear end of the mating section and parallel to the mating face 225 and a pair of guiding posts 224 disposed at two lateral sides thereof. The mating section 22 defines a first receiving port 221 and a second receiving port 222 adjoining to the first receiving port 221. the first receiving port 221 and the second receiving port 222 respectively defines a plurality of receiving passageways 228 extending through the mating face 225 and the end face 226.

The base section 21 comprises an elongated base plate 210 and a pair of seats 212 disposed at two sides thereof. The elongated base plate 210 provides a plurality of channels 211 at one side thereof along the longitudinal direction and behind the end face 226 for positioning the plurality of terminals 3 and a pair of tapered projections 216. Each seat 213 is rectangular shaped, and comprises a mounting face 213 for mounting on a circuit board and a receiving chamber 214 with a transversal extended opening. A pair of barb portions 217 extend opposite to each other and below the elongated base plate 210. A positioning post 218 extends downwardly from the barb portion. For securely positioning the electrical connector 1, a pair of locking elements 215 are provided to be assembled in the receiving chamber 214 by pass through the opening along a transversal direction.

Figure 4:
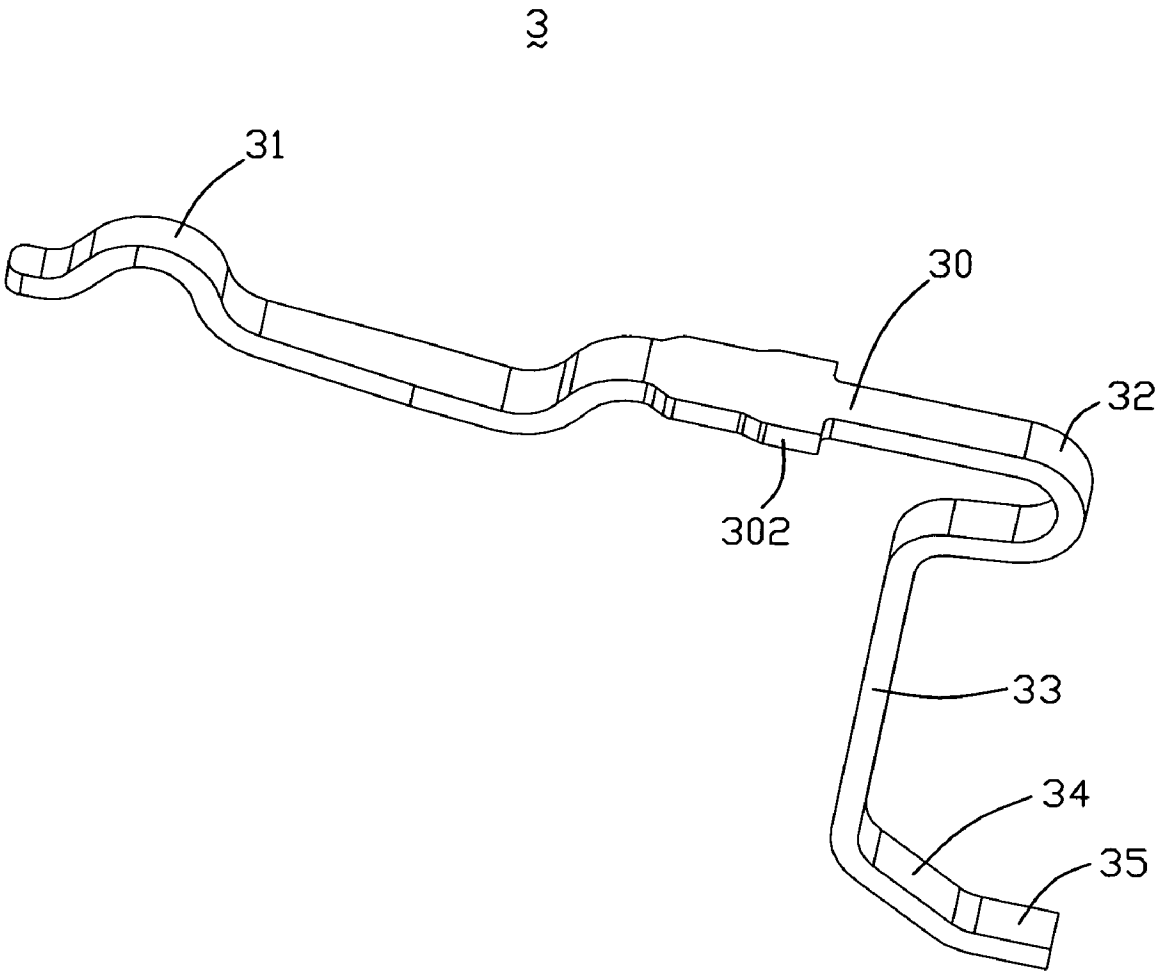
FIG. 4 is a perspective view of a terminal of an electrical connector according to the present invention.
Figure 5:
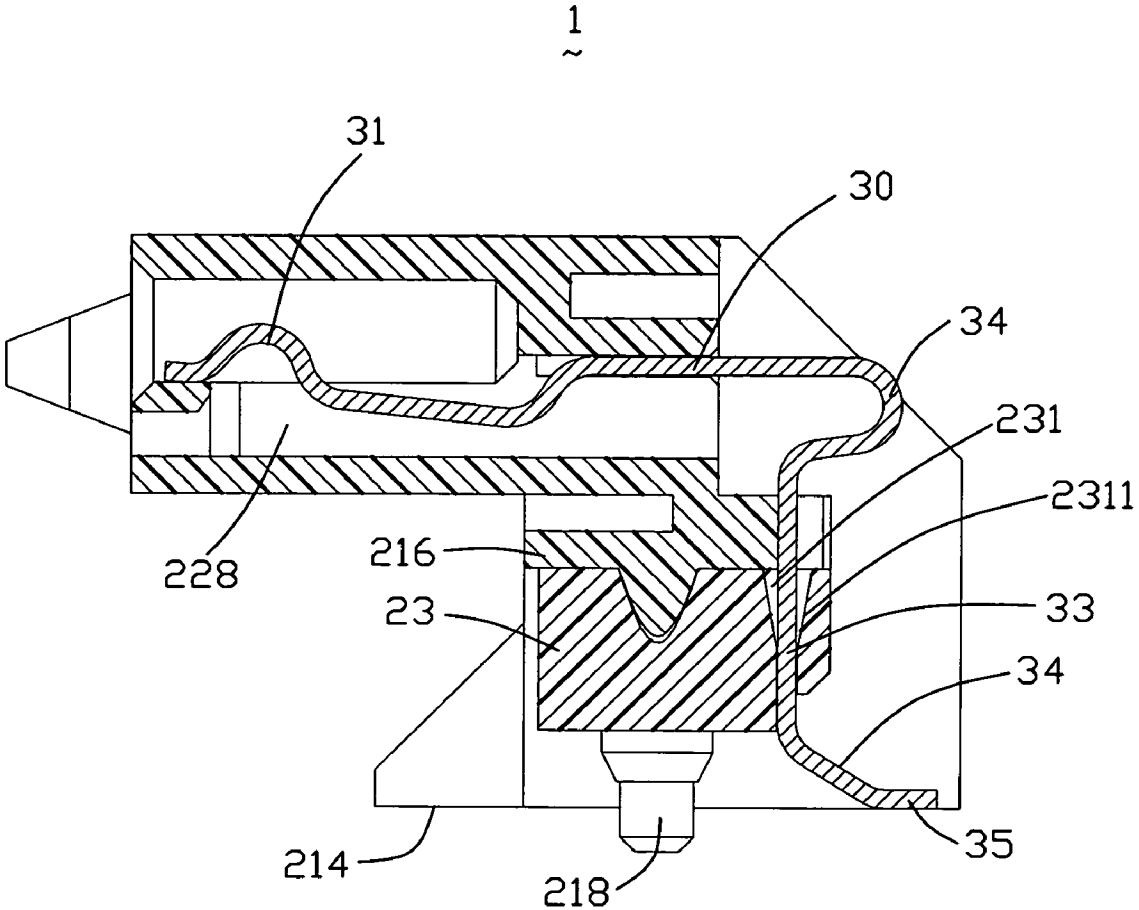
FIG. 5 is a cross-sectional view of FIG. 1 taken along line 5-5.
Figure 6:
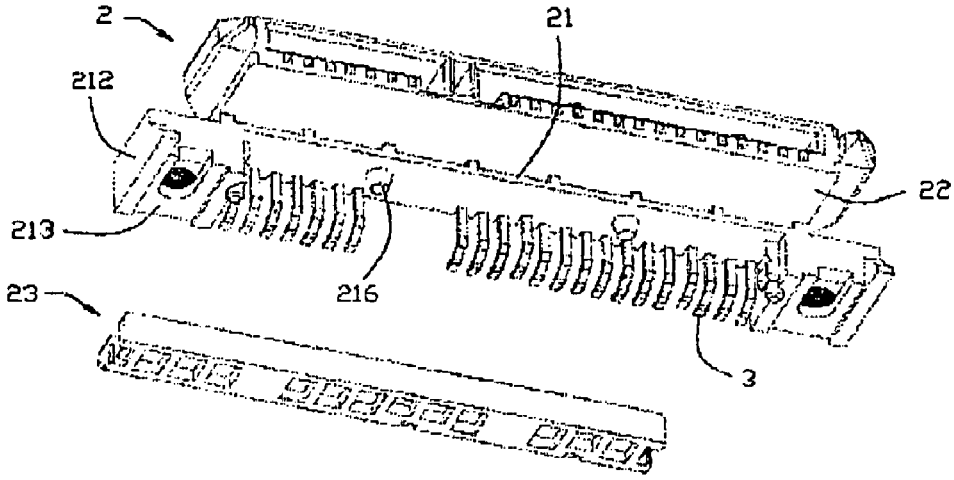
FIG. 6 is a partly assembled, perspective view of FIG. 1, while the spacer is not mounted onto the housing.

Referring to FIG. 4 and FIG. 5, the terminals 2 are divided into two groups for assembling to the first receiving port 221 and the second receiving port 222 respectively. Each terminal includes a retaining portion 30, a contacting portion 31 extending forwardly from the retaining portion 30, a buffering portion 32 extending rearward from the retaining portion 30, a positioning portion 33 extending downwardly from the connecting portion 32, a horizontally extending tail portion 35 for soldering on a circuit board and an inclined extending transitioning portion 34 connecting with the positioning portion 33 and the tail portion 35. In preferred embodiment, the buffering portion 32 is a transversal U-shaped connecting portion.

Referring to FIG. 3 and FIG. 5, in order to enhance positioning of the terminals 3 relative to the insulative housing 2, a spacer 23 can be provided below the elongated base plate 210 of the base section 21. The spacer 23 is elongated and shaped to compliant with the insulative housing 2 and the terminals 3, and comprises a plurality of through holes 231 corresponding to the channels 211, a pair of positioning holes 232 on the top surface thereof for engaging with the pair of tapered projection 216 of the elongated base plate 210 and a pair locking means integrally formed at two lateral sides thereof. Each through hole 231 defines an inclined surface 2311 adjoined to the top side thereof. Each locking means defines a recess 233 and a block 234 located in the recess 233 and having an inclined surface. Further, a plurality of concaves 236 formed on top surface of the spacer 23 are employed to enhance the intensity of the spacer 23.

In assembly, referring to FIGS. 1-5, the terminals 3 are respectively assembled into the receiving passageways 228 of the first receiving port 221 and the second receiving port 222 with the retaining portion 30 positioned therein, the buffering portion 320 extending away from the end face 226, the connecting portion 33 positioned in the channels 211. Then, the spacer 23 is assemble to the terminals 3 and locked with the base section 21 with the connecting portion 33 positioned in through holes 231 respectively, the pair of concaves 232 engaging with the pair of tapered projections 216, the pair locking means engaging with the barbs 217 by means of the engagement between the barbs 217 and blocks 234. A pair of locking elements 215 are respectively assembled into the receiving chamber 213 along a back-to-front direction through the openings of the seats 212 for positioning the insulative housing 2 with the circuit board. Lastly, the tail portions 35 are soldered onto the circuit board.

Summing up the foregoing, the buffering portion 32 can absorb the force upwardly exerting on the tail portions 35 of the terminals 3 when the electrical connector 1 is mounted onto the circuit board, and thus, prevent the contacting portions 31 of the terminals 3 from moving downwardly to establish a reliable electrical connection between the electrical connector 1 and the circuit board. The inclined surfaces 2311 of the through holes 231 are also preferable to enhance the effect mentioned-above.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a mating face, an end face parallel to the mating face, a mounting face perpendicular to the end face;

said insulative housing comprising a first receiving port and a second receiving port extending along a longitudinal direction perpendicular to a direction from the end face to the mating face with a plurality of receiving passageways therein, and a plurality of channels defined on the end face of the housing corresponding to the receiving passages;

a plurality of terminals assembled with the insulative housing, each terminal comprising a retaining portion securely retained in the passageways of the insulative housing, a contacting portion extending forwardly from the retaining portion, a buffering portion extending backwardly from the retaining portion, a tail portion extending parallel to the mounting face, and a substantial upright portion received in the channel of the housing and interconnecting with the buffering portion and the tail portion, wherein the base plate defines at least a tapered projection extending downwardly therefrom, wherein each seat defines said mounting face at the bottom side thereof, a receiving chamber with a transversal extending opening, a barb portion transversal extending therefrom and a positioning post extending downwardly from the barb portion, wherein the pair of barb portions extend opposite to each other and below the elongated base plate and a spacer provided below the elongated base plate of the base section and shaped to compliant with tile insulative housing and the terminals, wherein the spacer comprises a plurality of through holes corresponding to the plurality of channels, at least a positioning hole corresponding to the least tapered projection and a pair of locking means integrally formed at two lateral sides thereof for engaging with the pair of barb portion, wherein the spacer defines a plurality of concaves, wherein each locking means comprise a recess and a block disposed in the recess and having an inclined surface.

2. The electrical connector as claimed in claim 1, wherein the buffering portion is a transversal U-shaped connecting portion.

3. The electrical connector as claimed in claim 2, wherein the insulative housing is substantially elongated, and comprises a base section and a mating section extending upwardly and forwardly from the base section.

4. The electrical connector as claimed in claim 3, wherein the base section comprises an elongated base plate and a pair of seats disposed at two sides thereof.

5. The electrical connector as claimed in claim 4, wherein the base plate defines a plurality of channels at one side thereof along a longitudinal direction and corresponding to the plurality of receiving passageways.

6. The electrical connector as claimed in claim 2, wherein an inclined transitioning portion is disposed between the tail portion and the upright portion.

7. The electrical connector as claimed in claim 6, wherein the tail portion extends horizontally from the end the inclined transitioning portion to outside.

8. An electrical connector comprising:

an insulative housing comprising a substantially flat and elongated mating section and a base section integrally formed with and supporting the mating section;

said mating section defining a mating face, an end face parallel to the mating face, and a plurality of receiving passageways therein:

said base section defining a mounting face perpendicular to the end face;

a plurality of terminals assembled to the mating section of the insulative housing, each terminal comprising a retaining portion securely retained with the mating section, a contacting portion extending forwardly from the retaining portion a transversal U-shaped connecting portion extending backwardly from the retaining portion, a tail portion and a substantial upright portion interconnecting with the connecting portion and the tail portion, wherein the base section comprises an elongated base plate and the base plate defines at least a tapered projection extending downwardly therefrom, wherein each seat defines said mounting face at the bottom side thereof, a receiving chamber with a transversal extending opening, a barb portion transversal extending therefrom and a positioning post extending downwardly from the barb portion, wherein the pair of barb portions extend opposite to each other and below the elongated base plate and a spacer provided below the elongated base plate of the base section and shaped to compliant with tile insulative housing and the terminals, wherein the spacer comprises a plurality of through holes corresponding to the plurality of channels, at least a positioning hole corresponding to the least tapered projection and a pair of locking means integrally formed at two lateral sides thereof for engaging with the pair of barb portion, wherein the spacer defines a plurality of concaves, wherein each locking means comprise a recess and a block disposed in the recess and having an inclined surface.

9. The electrical connector as claimed in claim 8, further comprising a spacer provided below the elongated base plate of the base section and shaped to compliant with the insulative housing and the terminals.

10. An electrical connector comprising:

an insulative housing defining a horizontal mating port extending inwardly from a front face of the housing;

a plurality of passageways formed in the housing in commuication with the mating port;

a plurality of contacts received in the corresponding passageways, respectively;

a plurality of contact retaining slots formed in a rear face of the housing in each of a vertical section of the corresponding contact is received;

a contact tail spacer located under the housing and defining therein a plurality of through holes in vertical alignment with the corresponding slots, respectively; wherein a contact tail of each of the said contacts extends from the vertical section and through the corresponding hole and eventually in a horizontal manner, wherein the insulating housing is substantially elongate and comprises a base section and the base section comprises an elongated base plate, wherein the base plate defines at least a tapered projection extending downwardly therefrom, wherein each seat defines said mounting face at the bottom side thereof, a receiving chamber with a transversal extending opening, a barb portion transversal extending therefrom and a positioning post extending downwardly from the barb portion, wherein the pair of barb portions extend opposite to each other and below the elongated base plate and a spacer provided below the elongated base plate of the base section and shaped to compliant with tile insulative housing and the terminals, wherein the spacer comprises a plurality of through holes corresponding to the plurality of channels, at least a positioning hole corresponding to the least tapered projection and a pair of locking means integrally formed at two lateral sides thereof for engaging with the pair of barb portion, wherein the spacer defines a plurality of concaves, wherein each locking means comprise a recess and a block disposed in the recess and having an inclined surface.

11. The electrical connector as claimed in claim 10, wherein a pair of horizontal extending guiding posts are formed at two longitudinal ends of the mating port, and each of said guiding post is hollow in communication with an exterior at a rear end but not at a front end.

* * * * *